US008991412B2

(12) United States Patent
Holland et al.

(10) Patent No.: US 8,991,412 B2
(45) Date of Patent: Mar. 31, 2015

(54) PORTABLE FOLDING SHELTER

(71) Applicant: Pro Performance Sports, L.L.C., Carlsbad, CA (US)

(72) Inventors: Allen Holland, Sheffield (GB); William Parsons, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 0 days.

(21) Appl. No.: 13/940,041

(22) Filed: Jul. 11, 2013

(65) Prior Publication Data

US 2015/0013736 A1 Jan. 15, 2015

(51) Int. Cl.
*E04H 15/28* (2006.01)
*A45B 25/18* (2006.01)

(52) U.S. Cl.
CPC ..... *E04H 15/28* (2013.01)
USPC ..... 135/98; 135/33.5; 135/31

(58) Field of Classification Search
USPC ..... 135/98–99, 25.31–25.32, 29, 31, 33.5, 135/121, 144–147, 151, 120.3; 211/174; 403/83, 100–102
See application file for complete search history.

(56) References Cited

U.S. PATENT DOCUMENTS

| | | | | | |
|---|---|---|---|---|---|
| 922,925 | A * | 5/1909 | Loukota | 135/25.31 |
| 950,337 | A * | 2/1910 | Miller | 135/25.31 |
| 951,898 | A * | 3/1910 | Baird | 135/25.31 |
| 2,029,484 | A * | 2/1936 | Howard et al. | 403/100 |
| 2,146,517 | A * | 2/1939 | Thompson | 135/98 |
| 2,340,540 | A * | 2/1944 | Lange | 211/1.3 |
| 3,167,081 | A * | 1/1965 | Higgins | 135/98 |
| 3,448,748 | A | 6/1969 | Walrave | |
| 4,641,676 | A | 2/1987 | Lynch | |
| 4,779,635 | A | 10/1988 | Lynch | |
| 5,101,844 | A * | 4/1992 | Morrone | 135/33.5 |
| 5,421,356 | A | 6/1995 | Lynch | |
| 5,441,066 | A * | 8/1995 | Harris | 135/88.01 |
| 6,112,757 | A | 9/2000 | Tseng | |
| 6,283,136 | B1 | 9/2001 | Chen | |
| 7,367,348 | B2 | 5/2008 | Tsai et al. | |
| 7,836,903 | B2 * | 11/2010 | Kharag | 135/25.31 |
| 7,913,709 | B2 * | 3/2011 | Brebner | 135/33.5 |
| 8,701,692 | B2 * | 4/2014 | Holland et al. | 135/145 |
| 2003/0213513 | A1 | 11/2003 | Eriksen et al. | |
| 2006/0174929 | A1 | 8/2006 | Tseng | |
| 2007/0051397 | A1 | 3/2007 | Choi | |
| 2007/0221262 | A1 | 9/2007 | Tsai et al. | |
| 2011/0073148 | A1 | 3/2011 | Choi | |
| 2012/0006370 | A1 * | 1/2012 | Liljekvist et al. | 135/98 |

OTHER PUBLICATIONS

United States Patent and Trademark Office, Non-final Office Action in U.S. Appl. No. 13/458,528 dated Dec. 14, 2013.

* cited by examiner

*Primary Examiner* — Winnie Yip
(74) *Attorney, Agent, or Firm* — Kenneth H. Ohriner; Perkins Coie LLP

(57) ABSTRACT

A portable and foldable shelter has a canopy frame with an arm hub adjacent to a top end of a canopy pole, and a sliding collar on the pole. The canopy frame also includes a plurality of arms with each arm having an outer arm segment attached to an inner arm segment via an arm hinge joint. The arm hinge joint may include a slider movable into a locking position where the inner and outer arm segments are rigidly fixed in a straight locked-out. A flexible cover is attached to or supported on canopy frame. The portable shelter is lightweight, highly compact when folded, easy to use, and easy carry.

17 Claims, 8 Drawing Sheets

PORTABLE FOLDING SHELTER

BACKGROUND

Various umbrellas, tents, canopies and similar designs have been used to provide shelter. These devices typically have a fabric material supported on a folding framework. Typical umbrellas and canopies may be folded or collapsed, although they also tend to be bulky even when folded. Apart from the folded size, disadvantages also remain relative to weight, versatility, strength or durability, and ease of use of these types of shelters. Accordingly, it is an object of the invention to provide an improved foldable shelter.

SUMMARY OF THE INVENTION

A new portable and foldable shelter has now been invented which overcomes various disadvantages in existing designs. This new design is lightweight, highly compact when folded, easy to use, and easy carry. In one aspect, this new shelter a canopy frame with an arm hub adjacent to a top end of a canopy pole, and a sliding collar on the pole. The canopy also includes a plurality of arms with each arm having an outer arm segment attached to an inner arm segment via an arm hinge joint. When the shelter is unfolded, the arm hinge joint may be locked out, to hold the arm in a straight locked-out position. A strut may be provided on each of the arms, with the strut pivotally attached to the inner arm segment of the arm and to the collar. A flexible cover is attached to or supported on canopy frame. Other and further objects and advantages will become apparent from the following detailed description and drawings.

BRIEF DESCRIPTION OF THE DRAWINGS

In the drawings, the same element number indicates the same element in each of the views.

DETAILED DESCRIPTION OF THE DRAWINGS

Figure 1:
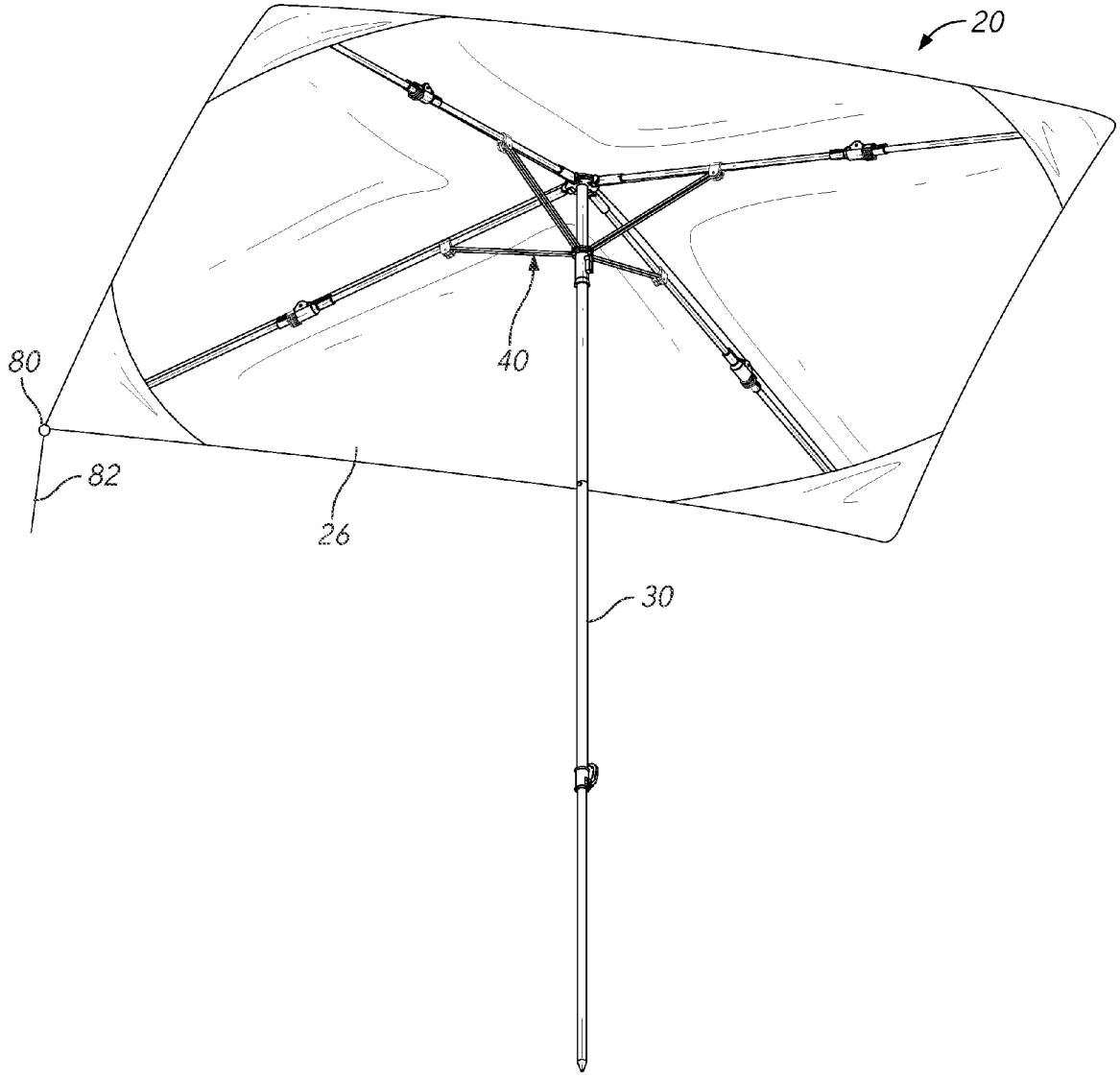
FIG. 1 is a perspective view of a new folding shelter in the erected or unfolded position, with the canopy section upright.
Figure 2:
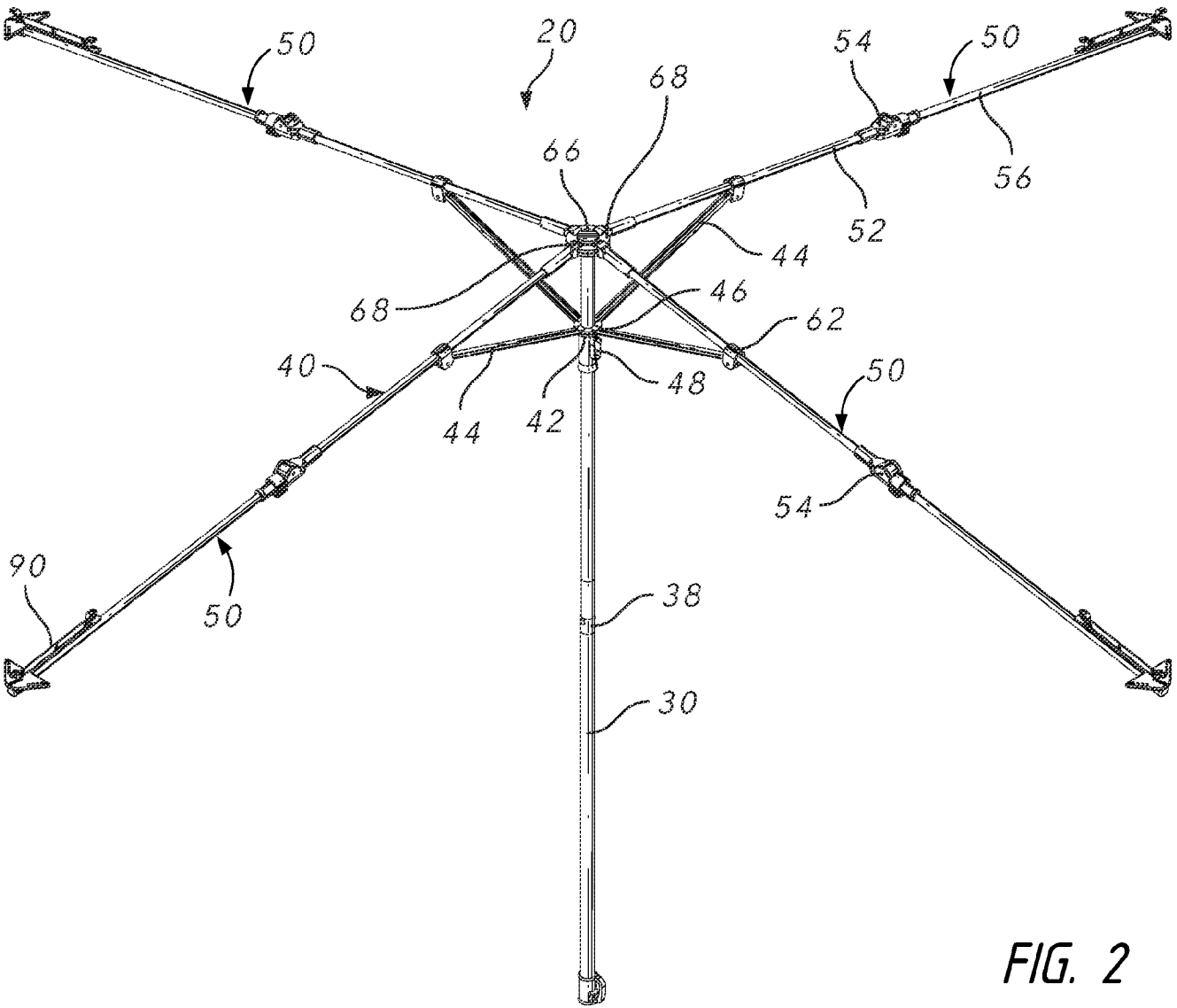
FIG. 2 is a perspective view of the canopy section of the foldable shelter as shown in FIG. 1, with the flexible material cover removed for purpose of illustration, to show the canopy frame alone.

Turning now in detail to the drawings, as shown in FIGS. 1 and 2, a portable shelter 20 has a canopy frame 40 which supports a flexible cover material 26. The cover material 26 is typically a sun blocking and weather resistant fabric. A layer of sun blocking material may be applied to the fabric. As shown in FIG. 2, the canopy pole 30 may include multiple sections that can be fitted together. The canopy pole 30 may optionally include a pivot joint 38, to allow the canopy section 22 to tilt over.

FIG. 2 shows the canopy frame 40 of the canopy section 22, but with the flexible cover material 26 removed for illustration. The canopy frame 40 includes the canopy pole 30 and a slide collar 42 on the pole 30. An arm hub 66 is provided at or near the top end of the pole 30. Arms 50 extend radially out from the arm hub 66. In the design shown, four equal length arms 50 are used, and the arms are oriented to hold the flexible cover 26 into a square shape. Of course, other numbers of arms 50 of varying lengths and orientations may be used with flexible covers of varying shapes and sizes.

The arms 50 each have an outer arm segment 56 attached to an inner arm segment 52 via a hinge joint 54. The inner end of each inner arm segment is pivotally attached to the arm hub 66 at a hub pivot joint 68. The arm hub 66 may be a separate piece including pivot joints for the inner ends of the inner arm sections. Alternatively the arm hub may be formed on or with the upper end of the pole 30, for example by attaching pivot joints to the pole 30.

An outer end of a strut 44 may be pivotally attached to the inner arm segment 52 of each arm 50 at a pivot collar 64. The pivot collar may be fixed in place, e.g., riveted, adhered, pressed, etc. on the inner arm segment 52. The inner end of each strut 44 is pivotally attached to the slide collar 42 at a collar pivot joint 46. A latch button 48 may be provided on the bottom end of the slide collar 42, for latching and releasing the slide collar 42 relative to the pole 30.

The pole 30, arms 50 and struts 44 may be a lightweight but strong and rigid material such as aluminum tubes, sections, bars, rods or extrusions. Alternatively, they may be made of fiberglass, wood, plastic or similar materials. While the arm hub 66, collars 62 and hinge joint 54 are shown as separate components, they may alternatively be provided with or as part of one of the other elements.

FIG. 2 shows the canopy frame 40 fully unfolded or erected. In this position, in the example shown, the flexible cover may take the form of four triangular flat panels extending downwardly and outwardly from the arm hub 66, or the peak of the shelter 20, generally in the shape of a rectangular four-sided pyramid. The cover 26 may of course also be provided in other shapes and polygons. The slide collar 42 is held up in position on the canopy pole 30 by the latch button 48, or via a lever, pin, or similar device. The canopy section 22 is collapsed or folded by releasing the latch button 48. This allows the slide collar 42 to slide down on the canopy pole 30, lowering the arms 50 towards the canopy pole.

Figure 3:
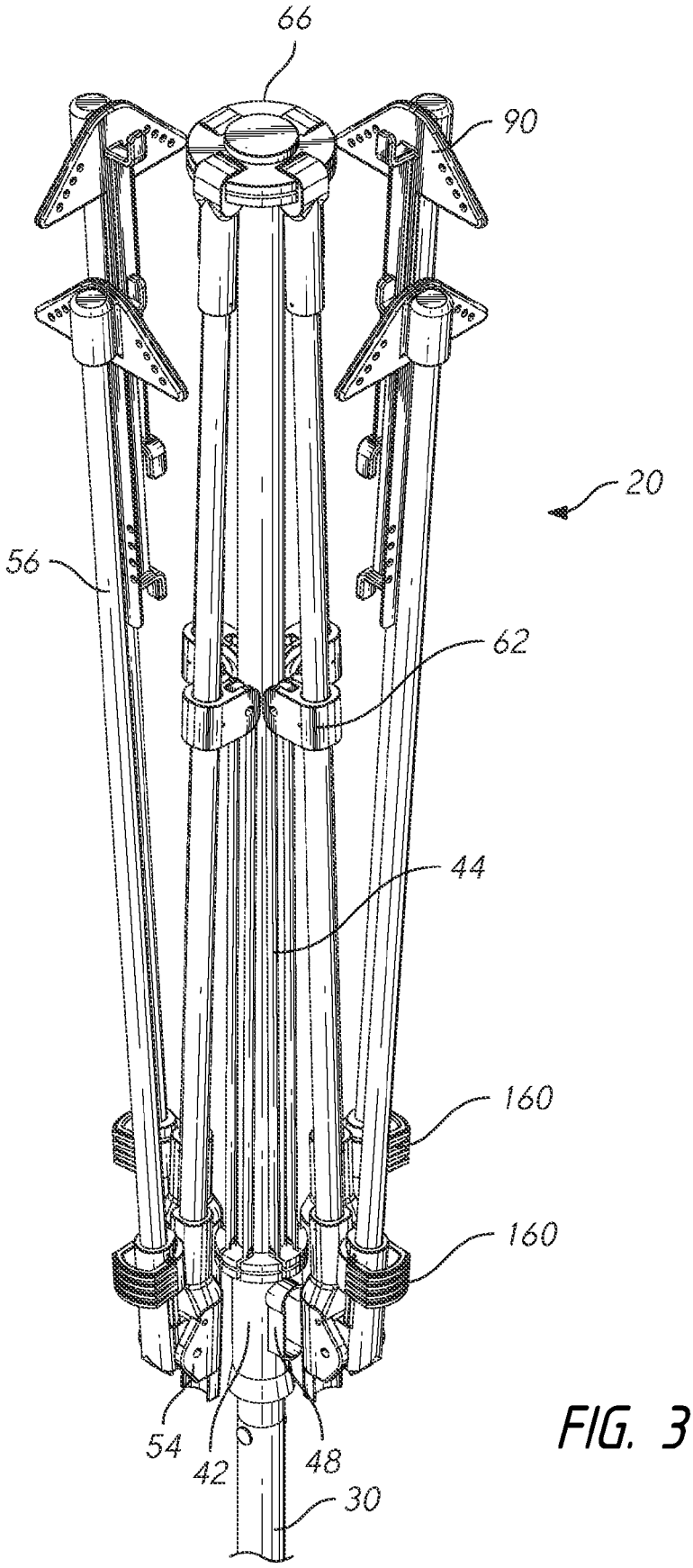
FIG. 3 is a perspective view of the canopy frame of FIG. 3 in a folded position.

As shown in FIG. 3, as the canopy frame 40 is folded, the outer arm segments 56 are folded upwardly about the hinge joints 54. Since the outer arm segments 56 fold in a direction opposite to the inner arm segments 52, the canopy section is highly compact when in the folded position. the canopy pole 30, or the folded or dismantled sections of the pole 30, may be equal to or only slightly longer than the rest of the folded canopy section 22. Specifically, the length of the canopy pole 30 may be less than or equal to the length of the folded canopy section 22. Or it may be up to 5%, 10% or 20% longer than the canopy pole.

As shown in FIG. 1, rings or eyelets 80 may be provided to attach tie down cords 82 to the shelter 20. The rings 80, if used, may be attached directly to the cover 26 or to the frame 40. One or more springs or other elastic or resilient elements may be included in the pole 30 or in the pole sections, to allow the pole to more quickly and easily assembled.

Figure 7:
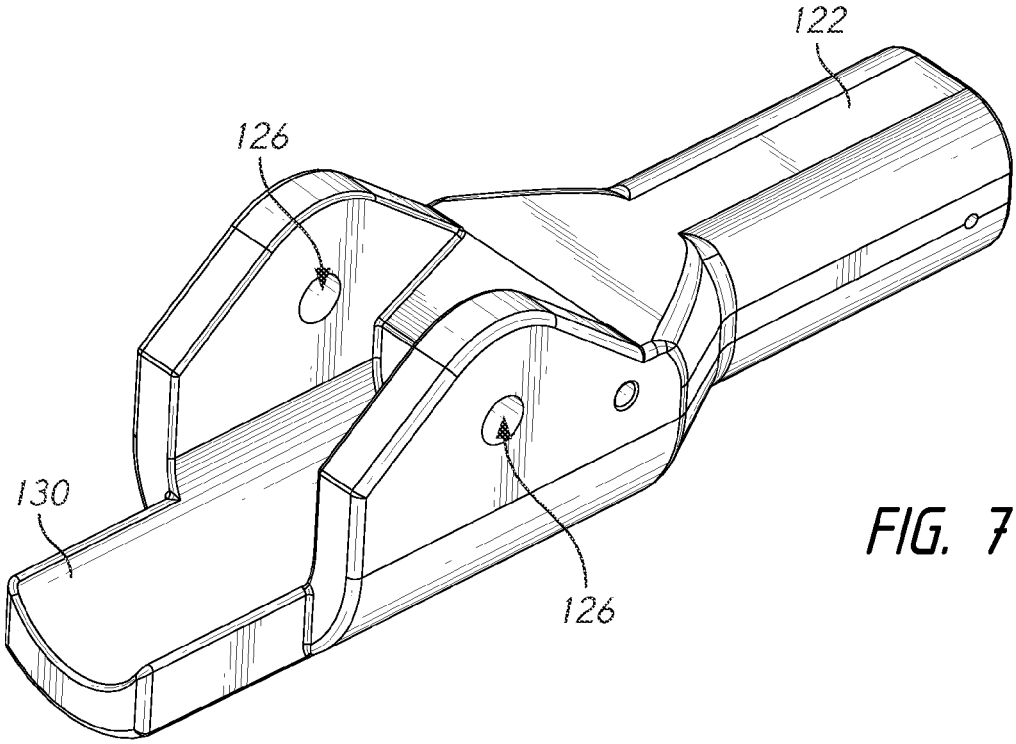
FIG. 7 is a top and right side perspective view of the inner fitting of the hinge joint shown in FIG. 5.
Figure 8:
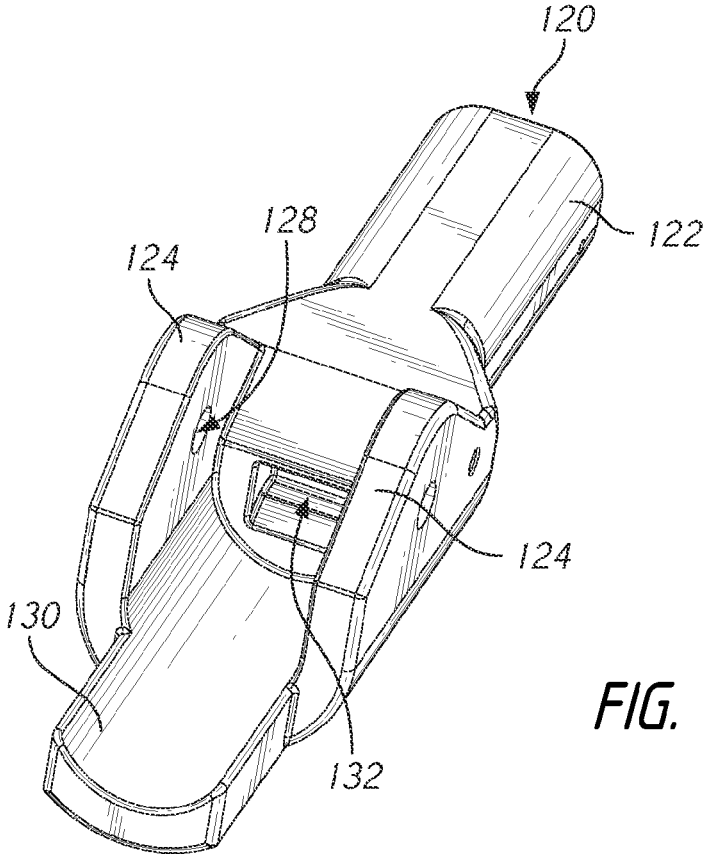
FIG. 8 is a top and front perspective view of the inner fitting of the hinge joint shown in FIG. 5.

The hinge joint 54 may be designed to allow the outer arm segment 56 to pivot or fold up into a compact configuration, while also rigidly attaching and locking the outer arm segment 56 to the inner arm segment 52 when the shelter is unfolded. As shown in FIGS. 5-8, a tube section 122 of an inner fitting 120 is attached to the outer end of the inner arm segment 52. The inner fitting 120 may have spaced apart shoulders 124 with a pin 128 extending into or through pin holes 126 in the shoulders 124. The inner fitting 120 may also have a plate section 130 extending out from between the shoulders 124. The plate section 130 may be concave and curve upwardly, as shown in FIGS. 7 and 8. As shown in FIG. 8, a slot 132 may be provided between the shoulders 124.

Figure 4:
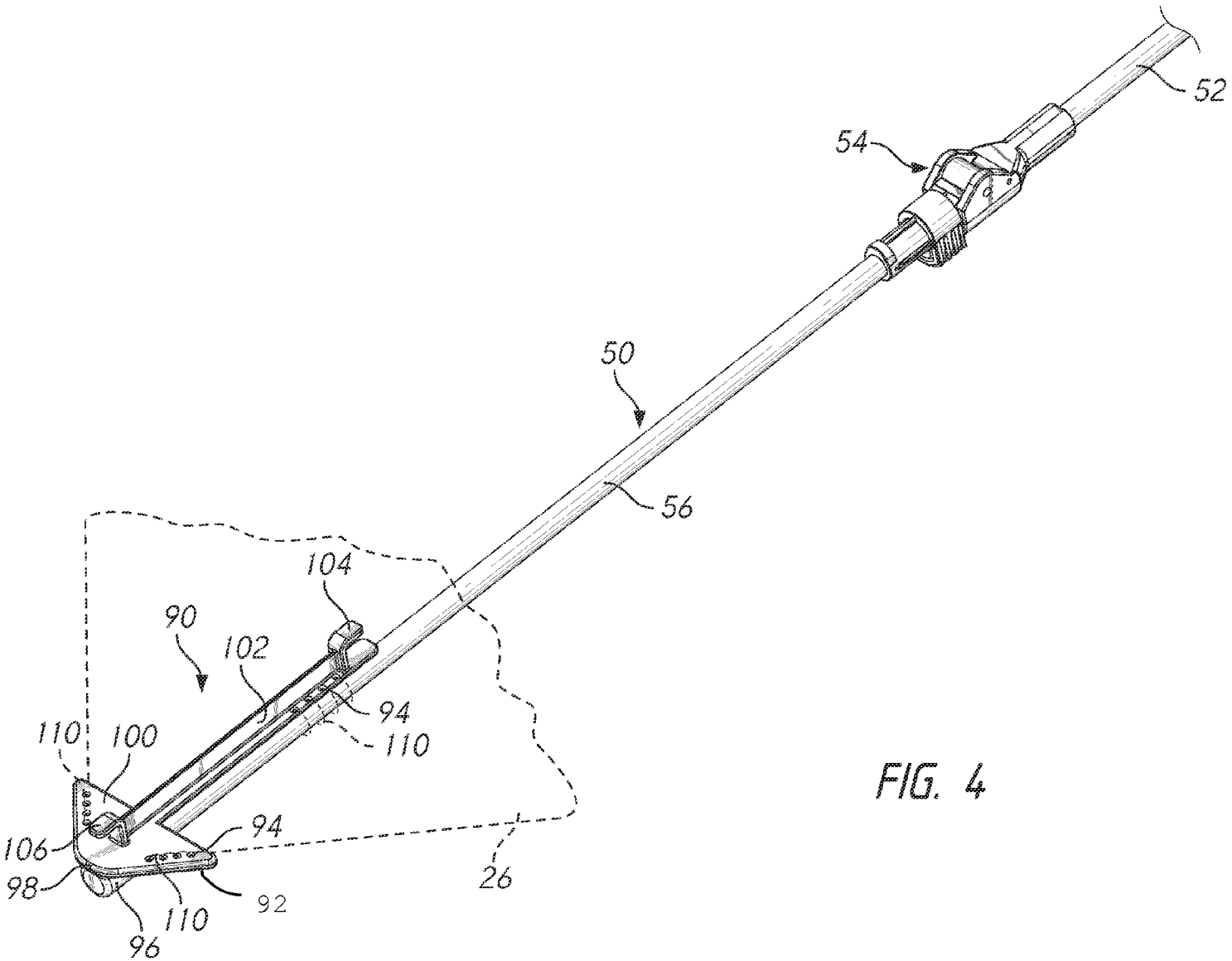
FIG. 4 is a perspective view of an arm of the canopy frame in the unfolded position.

As shown in FIG. 4, an arm cap 90 is attached to the outer end of the outer arm segments 56. The arm cap 90 may include a bottom plate 92 and a top plate 100 optionally connected to the bottom plate 92 via a hinge or strap section 98. In the example shown, the top and bottom plates 100 and 92 are generally triangular and of equal size and shape. A T-leg may be attached to the top plate 100 and extend inwardly on top of the outer arm segment 56. Inner and outer hooks 104 and 106 may be provided at the inner and outer ends of the T-leg 102. A cup 96 on the bottom plate 92 may be fitted over the outer tip of the outer arm segments.

The cover fabric or material 26 is captive between the top and bottom plates 100 and 92 of the arm cap 90. Stitching 110 passing through holes 94 in the top and bottom plates, and through the fabric 26, secures the fabric in place. Stitching may similarly also attached the inner end of the T-leg 102 onto the outer arm segment 56. The stitching may be replaced by equivalents, such as fasteners, clips, adhesives, etc.

Figure 5:
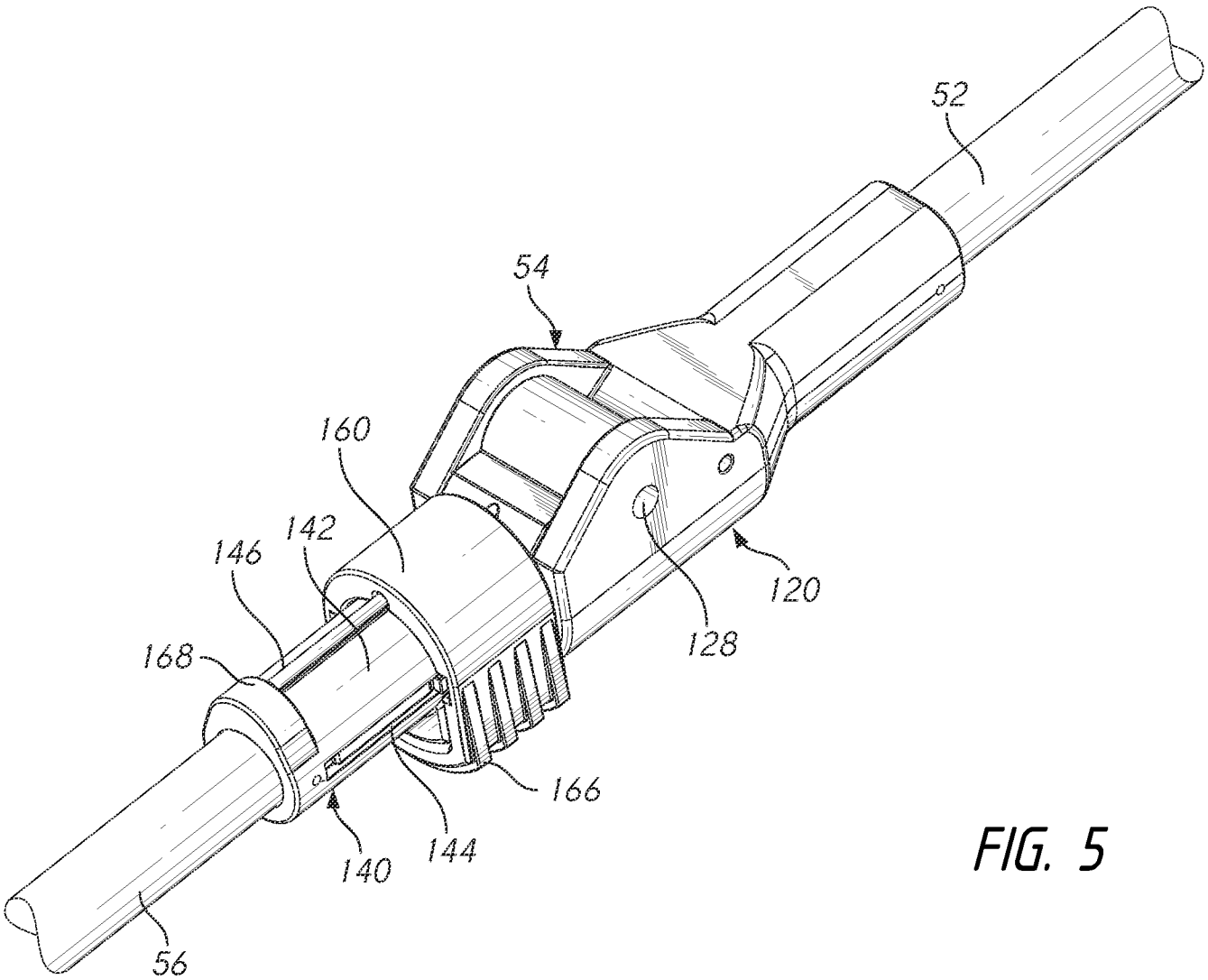
FIG. 5 is a top and left side perspective view of the hinge joint shown in FIG. 4.
Figure 9:
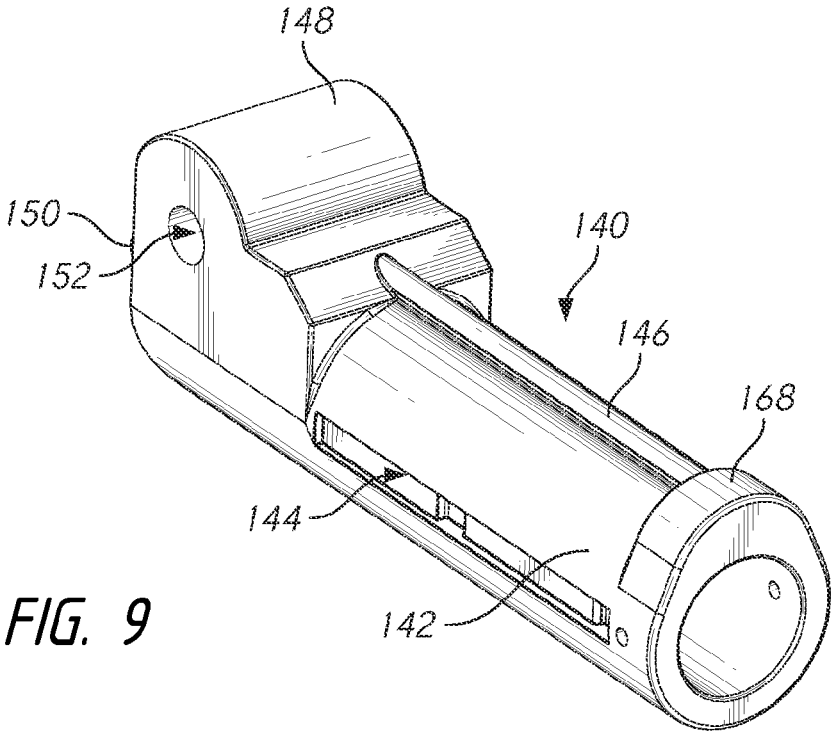
FIG. 9 is a top and back end perspective view of the outer fitting of the hinge joint shown in FIG. 5.
Figure 10:
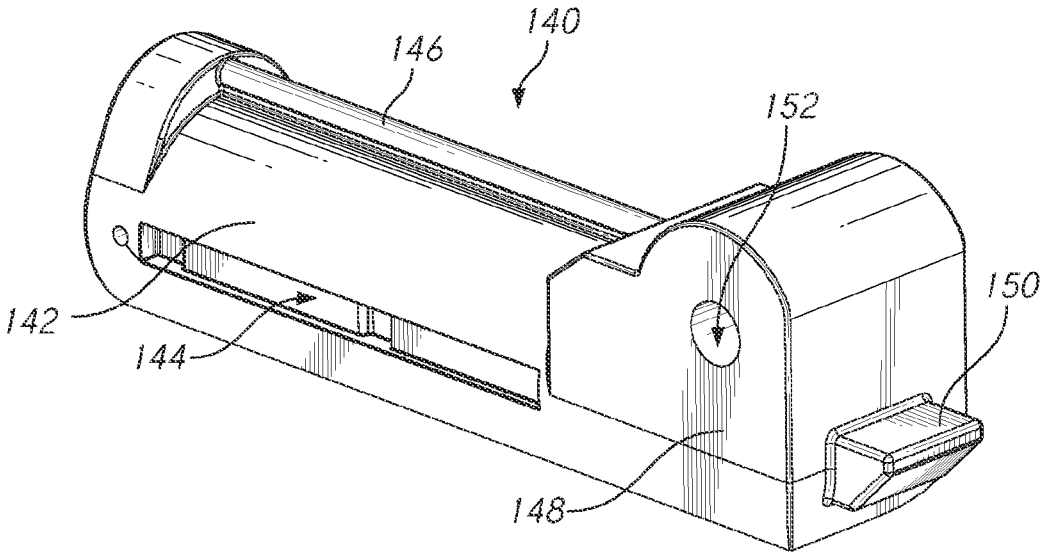
FIG. 10 is a top and front end perspective view of the outer fitting of the hinge joint shown in FIG. 5.

As shown in FIG. 5, an outer fitting 140 is pivotally attached to the inner fitting 120. Referring to FIGS. 9 and 10, the inner end of the outer arm segment 56 is attached to a tube section 142 of the outer fitting 140. The tube section 142 may have one or more side slots 144 and rails 146. The tube section 142 is joined to or integral with a base section 148. The pin 128 shown in FIG. 5 extends through a hole 152 in the base, to pivotally attach the outer fitting 140 to the inner fitting 120. A tab or stop 150, optionally having an angled bottom surface, may extend inwardly from the base 148. A slider stop 168 may be provided on a top surface of the outer end of the tube section 142.

Figure 6:
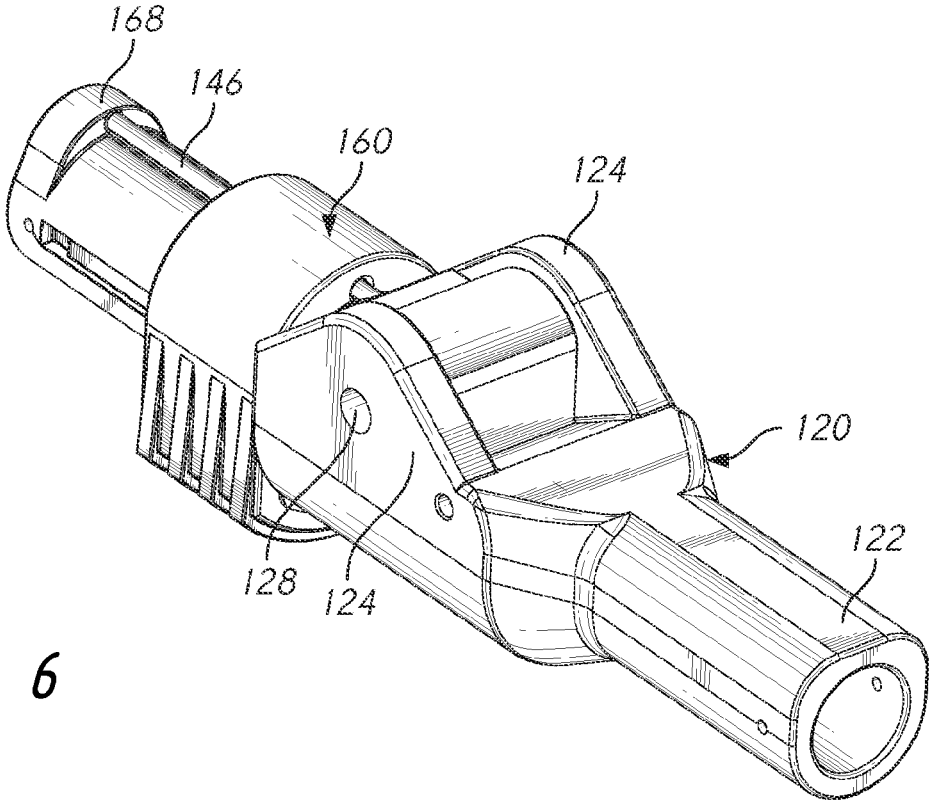
FIG. 6 is a top and right side perspective view of the hinge joint shown in FIG. 4.
Figure 11:
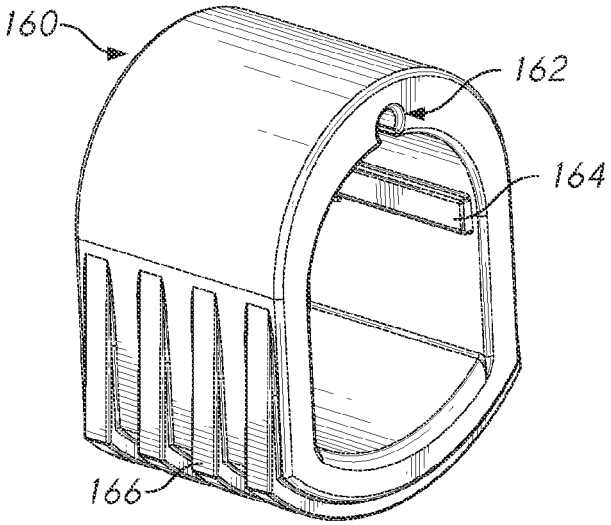
FIG. 11 is a perspective view of the slider shown in FIG. 5.

As shown in FIGS. 5, 6 and 11, a slider 160 is secured onto the tube section 142 of the outer fitting 140. The slider 160 may have a rail slot 162 engaged over each rail 146 on the tube section 142. The slider may also have slot tracks 164 that protrude into the side slots 144 of the tube section 142 of the outer fitting 140. The slider can slide on the tube section 142 from the inner or locked position shown in FIGS. 5 and 6, to an outer or unlocked position where the slider 160 is over or adjacent to the slider stop 168.

FIG. 3 shows the frame 40 in the folded position. Typically, during storage or transport, a lower section of the pole 30 is detached from the frame 40, to provide a more compact design. In use, the lower pole section is attached to the frame 40, and then the frame 40 is unfolded or erected. Specifically, the shelter 20 is removed from its carrying bag, if any. The outer arm segments 56 are flipped or folded down. The tab 150 moves into the slot 132, if used. The slide collar 42 is pushed up towards the arm hub until it reaches an upper locking position engaged by the latch button 48. In designs where the slide collar 42 also has a lower locking position, this movement may first require pressing in on the latch button 48 to release the slide collar from the lower locking position.

With the arms extended, the slider 160 is pushed in towards the base 148 of the outer fitting 140. The slider 160 slides over the plate section 130 of the inner fitting. This locks the arm segments together. The tab 150, the plate section 130 and/or the inside surface of the slider 160 may optionally have angled or tapered surfaces to provide a camming or wedging action between the inner and outer fittings. The erected shelter 20 accordingly has rigid structure. The fabric 26 may be dimensioned so that it fits tightly over the frame 40 when the frame is in the unfolded or erected position. The hooks 104 and 106 on the arm caps 90 allow the corners of the shelter 20 to be conveniently tied to the ground, to another shelter, or another structure using cord or rope. The shelter 20 may be folded and stored using the reverse of the sequence described above.

Thus, a novel foldable and easily portable shelter has been shown and described. Various changes and substitutions may of course be made without departing from the spirit and scope of the invention. The invention, therefore, should not be limited except to the following claims and their equivalents.

The invention claimed is:

1. A portable shelter, comprising:

a canopy frame including:

a canopy pole;

an arm hub adjacent to a top end of the pole;

a slide collar on the pole;

a plurality of arms with each arm including: an inner arm segment having an inner end pivotally attached to the arm hub, and an outer arm segment pivotally attached to an outer end of the inner arm segment via a hinge joint;

with the hinge joint having an inner fitting on the inner arm segment and an outer fitting on the outer arm segment, and a collar slidable to lock the inner and outer fittings together;

on each one of the arms, a strut having an outer end pivotably attached to the inner arm segment of the arm, and an inner end pivotably attached to the slide collar; and an arm cap configured to be attached on at least one of the outer arm segments, wherein the arm cap includes a top plate and a bottom plate and wherein an outer end portion of the at least one outer arm segment extends below the bottom plate; and a fabric cover configured to be attached between the top plate and the bottom plate of the arm cap.

2. The portable shelter of claim 1 wherein the inner fitting of one or more of the hinge joints includes a bottom plate partially overlying the outer fitting.

3. The portable shelter of claim 1 wherein the arm hub comprises a cap covering the top end of the canopy pole.

4. The portable shelter of claim 1 with the canopy pole including two or more detachable pole sections.

5. The portable shelter of claim 1 comprising four arms with the fabric cover comprising a polygon.

6. The portable shelter of claim 1 wherein the arm cap comprises a cup attached to the bottom plate and over the outer end portion of the at least one outer arm segment.

7. The portable shelter of claim 1 with the canopy frame movable from a folded position wherein the inner arm segments are adjacent and substantially parallel to the pole, to unfolded position wherein the inner arm segments extend away from the arm hub at a declined angle, and wherein the inner arm segments pivot in a first direction, and the outer arm segments are pivotable only in a second direction, opposite to the first direction, with the canopy frame moved from the folded position to the unfolded position.

8. The portable shelter of claim 7 wherein, on each arm, the outer arm segment is folded over next to, and substantially parallel to the inner arm segment, when the canopy frame is in the folded position, and the outer arm segment is aligned with, and substantially parallel to, the inner arm segment, when the canopy frame is in the unfolded position.

9. The portable shelter of claim 1 wherein the arm cap extends inwardly over the outer arm segment by at least 4 inches.

10. The portable shelter of claim 9 wherein an inner end of the arm cap is attached to the outer arm segment and to the fabric cover.

11. The portable shelter of claim 1 wherein the arm cap comprises a T-leg structure attached to the top plate and extending inwardly on top of the at least one outer arm segment.

12. The portable shelter of claim 11 wherein the T-leg comprises a hook attached to at least one of an inner and outer end of the T-leg.

13. The portable shelter of claim 11 wherein the T-leg is configured to be secured to the at least one outer arm segment via one or more fasteners.

14. The portable shelter of claim 13 wherein the one or more fasteners comprise stitching configured to secure the T-leg to the at least one outer arm segment via one or more holes in the T-leg.

15. The portable shelter of claim 1 wherein the bottom plate and the top plate are hingedly coupled.

16. The portable shelter of claim 15 wherein one or more fasteners are configured to secure the fabric cover to the top plate and the bottom plate.

17. The portable shelter of claim 16 wherein the one or more fasteners comprise stitching configured to secure the fabric cover to the arm cap via corresponding holes in the fabric cover, bottom plate, and top plate.

* * * * *